US006370353B1

(12) United States Patent
Baughman et al.

(10) Patent No.: US 6,370,353 B1
(45) Date of Patent: Apr. 9, 2002

(54) PRESSURE ROLLER SYSTEM AND AN IMPROVED METHOD FOR INSTALLING A PRESSURE ROLLER

(75) Inventors: Richard C. Baughman, Geneseo; Terry N. Morganti, Brockport; James V. Orchard, II, Holley, all of NY (US)

(73) Assignee: Heidelberg Digital, L.L.C., Rochester, NY (US)

( * ) Notice: Subject to any disclaimer, the term of this patent is extended or adjusted under 35 U.S.C. 154(b) by 0 days.

(21) Appl. No.: 09/689,515

(22) Filed: Oct. 12, 2000

(51) Int. Cl.[7] ..... G03G 15/20
(52) U.S. Cl. ..... 399/331
(58) Field of Search ..... 399/110, 122, 399/126, 331, 339, 320; 219/216

(56) References Cited

U.S. PATENT DOCUMENTS 4,428,660 A * 1/1984 Matsumoto ..... 399/122
4,802,439 A * 2/1989 Sugimoto et al. ..... 399/339 X
5,283,621 A * 2/1994 Hashizume ..... 399/331
5,572,307 A * 11/1996 Tomatsu et al. ..... 399/122
5,848,331 A * 12/1998 Fromm ..... 399/122
6,035,160 A * 3/2000 Kim ..... 399/122
6,269,230 B1 * 7/2001 Kiuchi ..... 399/122

* cited by examiner

*Primary Examiner*—Susan S. Y. Lee

(57) ABSTRACT

A copier/duplicator machine having a pressure roller system including two load arms for engagement with pressure roller bearings on each end of the pressure roller wherein the load arms include locator plates positioned on their outsides and extending beyond an engagement surface on each load arm and toward and past engagement surfaces on the pressure roller bearings to restrict the positioning of the load arm engagement surfaces so that the load arms can be installed only in proper engagement with the pressure roller bearings on the ends of the pressure roller.

9 Claims, 5 Drawing Sheets

PRESSURE ROLLER SYSTEM AND AN IMPROVED METHOD FOR INSTALLING A PRESSURE ROLLER

FIELD OF THE INVENTION

This invention relates to an improved method for installing a pressure roller and an improved load arm configuration to ensure that the pressure roller is installed in proper engagement with the load arms.

BACKGROUND OF THE INVENTION

In the production of copies by electrophotographic processes, a continuous loop of photoconductor film is commonly used. This photoconductor film is charged initially, in a primary charging section thereafter passed to an imagining section, a developing section, and an image transfer section where a toner image on the photoconductor film is transferred to a paper or other transfer surface to produce a copy of the toner image on the paper or other transfer surface. The paper is subsequently passed to a fuser section where the toner image on the paper is fixed to the paper by elevated pressure and temperature. The photoconductor film then passes through a neutralization section and thereafter past a brush cleaner which removes contaminants from the film prior to passing the photoconductor film back through the primary charging section.

In the fuser section, typically a pressure roller is in contact with a fuser roller to subject the paper bearing the toner image to temperature and pressure to fix the toner image on the paper. As well known to those skilled in the art, the fuser roller may be heated directly or indirectly. Further either the fuser roller or pressure roller may be directly or indirectly driven to rotate the two rollers.

The pressure imposed on the fuser roller is imposed typically by imposing a pressure on the pressure roller. This pressure is created by load arms, which impose the pressure load on the pressure roller. Typically the load is about 325 to about 375 pounds. Typically two load arms are used, one of each end of the fuser roller.

In some embodiments it has been found that the load arms have been improperly placed in engagement with pressure roller bearing surfaces on the pressure roller. This misalignment is a result of positioning the pressure roller in a slightly out of alignment position. As a result of this misalignment, the load arms can be placed in engagement with spacer washers, which are positioned on the ends of the pressure roller to maintain pressure roller bearing surfaces at a desired position relative to the pressure roller. The positioning of the pressure roller in a slightly out of alignment position results in the load arms engaging the washers on the pressure roller on one side and only partially engaging the pressure roller bearing surfaces on the other side of the pressure roller. This misalignment can cause many problems in operation, in the closing of a cooler section, which is rotatably closable over the lower portion of a fuser section and the like. The difficulty in properly installing the pressure roller is in part due to its inaccessibility since cooler sections are designed to open by only about 70 degrees from the lower portion of the fuser section.

Accordingly, a continuing effort has been directed to the development of improved load arm configurations and improved methods for installing the pressure roller to avoid the misalignment of the load arms with the pressure roller bearing surfaces.

SUMMARY OF THE INVENTION

According to the present invention, it has been found that improved reliability is achieved in a copier/duplicator machine having a pressure roller system including two load arms for engagement with pressure roller bearing surfaces on each end of a pressure roller wherein the load arms include locator plates positioned on their outsides and extending beyond an engagement surface on each load arm and toward and past the pressure roller bearing surfaces to restrict the positioning of the load arm engagement surfaces so that the load arms can be installed only in proper engagement with the pressure roller bearings on the ends of the pressure roller.

The invention further comprises a load arm system for a copier/duplicator machine for applying pressure to a pressure roller having pressure roller bearings positioned on its ends, the pressure roller bearings having pressure roller bearing engagement surfaces, the system comprising: two load arms each having a first and a second end and being retained in a fixed spatial relationship to each other, each having a load arm engagement surface configured for engagement with the pressure roller bearing engagement surfaces at their first ends, and rotatably connected at their first ends to the machine for rotation of the load arm engagement surfaces into engagement with the pressure roller bearing engagement surfaces; a pressure source in operative contact with the second ends of the load arms and adapted to apply a selected pressure to the pressure roller by applying a selected pressure to the second ends of load arms; a locator plate positioned on the outside of the first ends of the load arms and extending past the load arm engagement surfaces and the pressure roller bearing engagement surfaces so that when the load arms are installed with the locator plates outside the pressure roller bearing engagement surfaces the pressure roller and load arms are properly positioned.

The invention still further comprises a method for installing a pressure roller in a copier/duplicator machine in proper orientation to load arms rotatably connected to the machine, the method comprising: configuring a machine cooler section openable by rotary movement relative to a lower fuser unit section for rotary movement to an open position wherein the cooler section is rotated to an angle greater than 70 degrees relative to the lower fuser section thereby providing improved access to the lower fuser section for installation of a pressure roller; positioning the pressure roller in a pressure roller receptacle in the lower fuser section of the machine; positioning locator plates on the load arms so that the load arms can be moved into engagement with the pressure roller only when the load arms are in proper alignment with pressure roller bearing surfaces on the pressure roller; and, moving the load arms into properly aligned engagement with the pressure roller bearing surfaces.

DESCRIPTION OF THE PREFERRED EMBODIMENTS

In the description of the Figures, the same numbers will be used throughout to refer to the same or similar components. Of the various component parts shown in the Figures, only those necessary for the disclosure of the present invention will be discussed.

Figure 1:
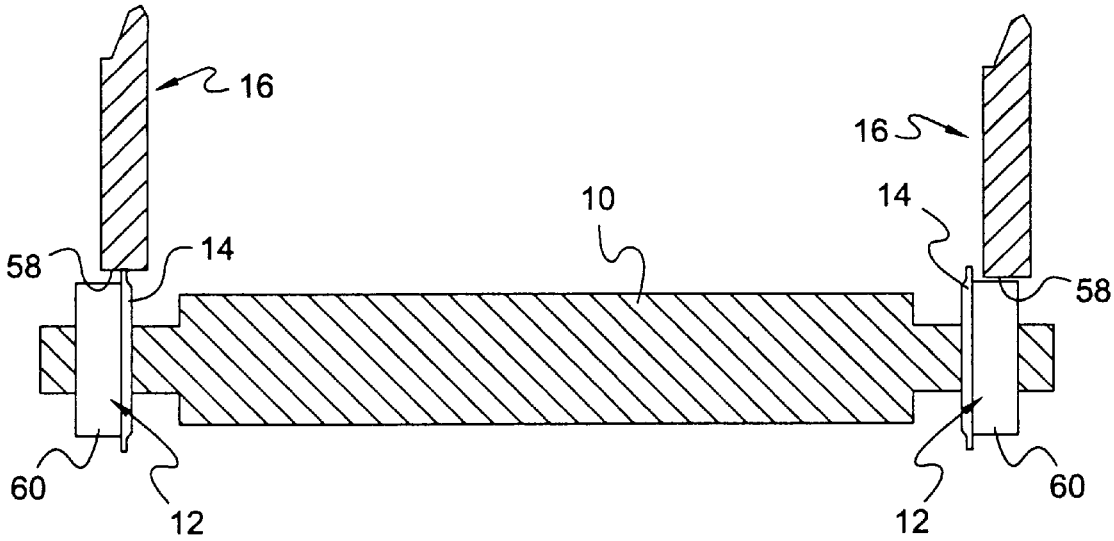
FIG. 1 is a schematic diagram of a load arm in a misaligned installation with a fuser roller.

In FIG. 1, a pressure roller 10 is shown with pressure roller bearings 12 which may comprise ball bearings having pressure roller engagement surfaces 60. Retaining rings 14 are shown between each pressure roller bearing 12 and pressure roller 10. These retaining rings are somewhat larger in diameter than pressure roller bearings 12. As shown, a load arm assembly 16 comprising load arms 16 is in engagement with on one side the outside of a retaining ring 14 and on the other side partially in engagement with an engagement surface 60. This results in an uneven alignment of the load arms and difficulty in closing a cooling section 32 of a fuser unit section which typically closes over the load arm assembly and the pressure roller and results in uneven application of pressure on pressure roller 10 and numerous other difficulties. The difficulties in obtaining correct alignment between pressure roller 10 and load arms 16 can arise from many reasons which can include as a primary cause misalignment of pressure roller 10 as it is installed in a fuser section A of a copier/duplicator machine. This difficulty arises in part because typically cooling section 32 of the fuser unit section is designed to open only to about 70 degrees above a lower portion 50 of the fuser unit section. This results in difficulty in accessing a pressure roller receptacle (not shown) for the installation of the pressure roller.

Figure 2:
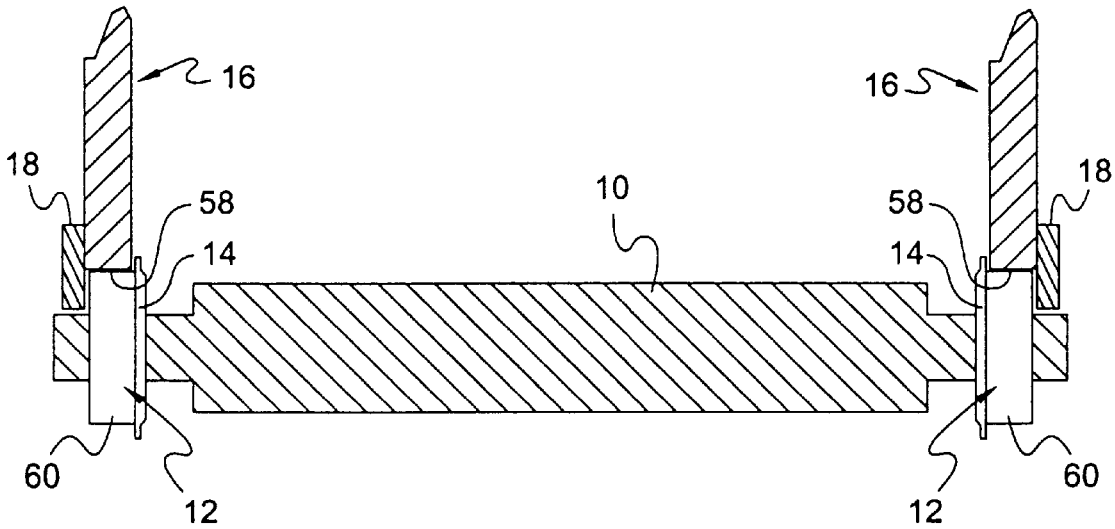
FIG. 2 is a schematic diagram of load arms in proper alignment with the fuser roller wherein the load arms include locator plates according to the present invention.

In FIG. 2, a pair of load arms 16 are shown in proper alignment with a pair of load arm engagement surfaces 58 in engagement with pressure roller bearing engagement surfaces 60. These load arms are maintained in a proper position by locator plates 18 which are positioned on the outside of load arms 16 and extend beyond engagement surfaces 58 on the lower ends of load arm 16 and past engagement surfaces 60 on pressure roller bearings 12. This ensures that the load arms must be in proper alignment on each side of the pressure roller in order for the load arms to extend to a sufficiently lowered position to permit closing the cooler section. This ensures that the pressure roller will be installed in correct alignment with the load arms prior to the operator being able to close and continue to operate the machine.

Figure 3:
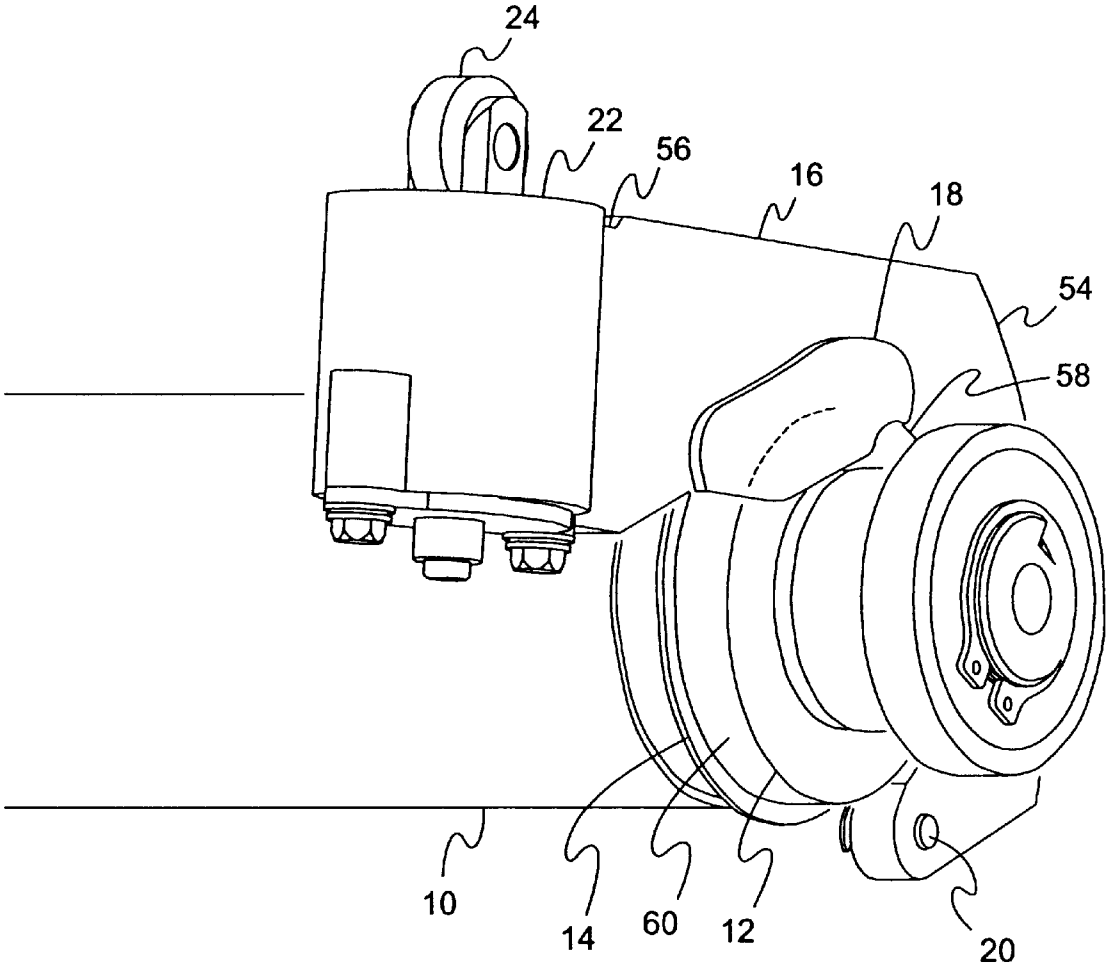
FIG. 3 is a schematic diagram of a load arm according to the present invention in engagement with a pressure roller.

In FIG. 3, a more detailed schematic diagram of a load arm 16 according to the present invention is shown. A bearing 12 having an engagement surface 60 is shown positioned on a pressure roller 10. A retaining ring 14 is also shown. Arm 16 is connected at a pivot 20 for rotational movement into engagement of engagement surface 58 of the load arm 16 with the engagement surface 60 of the pressure roller bearing. A locator plate 18 is positioned on the outside of arm 16 so that arm 16 cannot be lowered into engagement with surface 60 unless locator plates 18 are outside surfaces 60. This ensures that when arm 16 is rotated into engagement with surfaces 60 the pressure roller is properly oriented with respect to arm 16. Arm 16 as shown also includes a second end 56 which includes a spring assembly 22 which includes a roller or other contact means 24 and a chamber including a spring (not shown) which is compressible by slideable movement of roller 24 or other contact point in the chamber to produce a desired pressure on pressure roller 10. Generally roller 24 is engaged by a cam in the cooler section when the cooler section is closed. During copying the cam produces a desired pressure on roller 24 to produce the desired pressure on pressure roller 10 as known to those skilled in the art.

Figure 4:
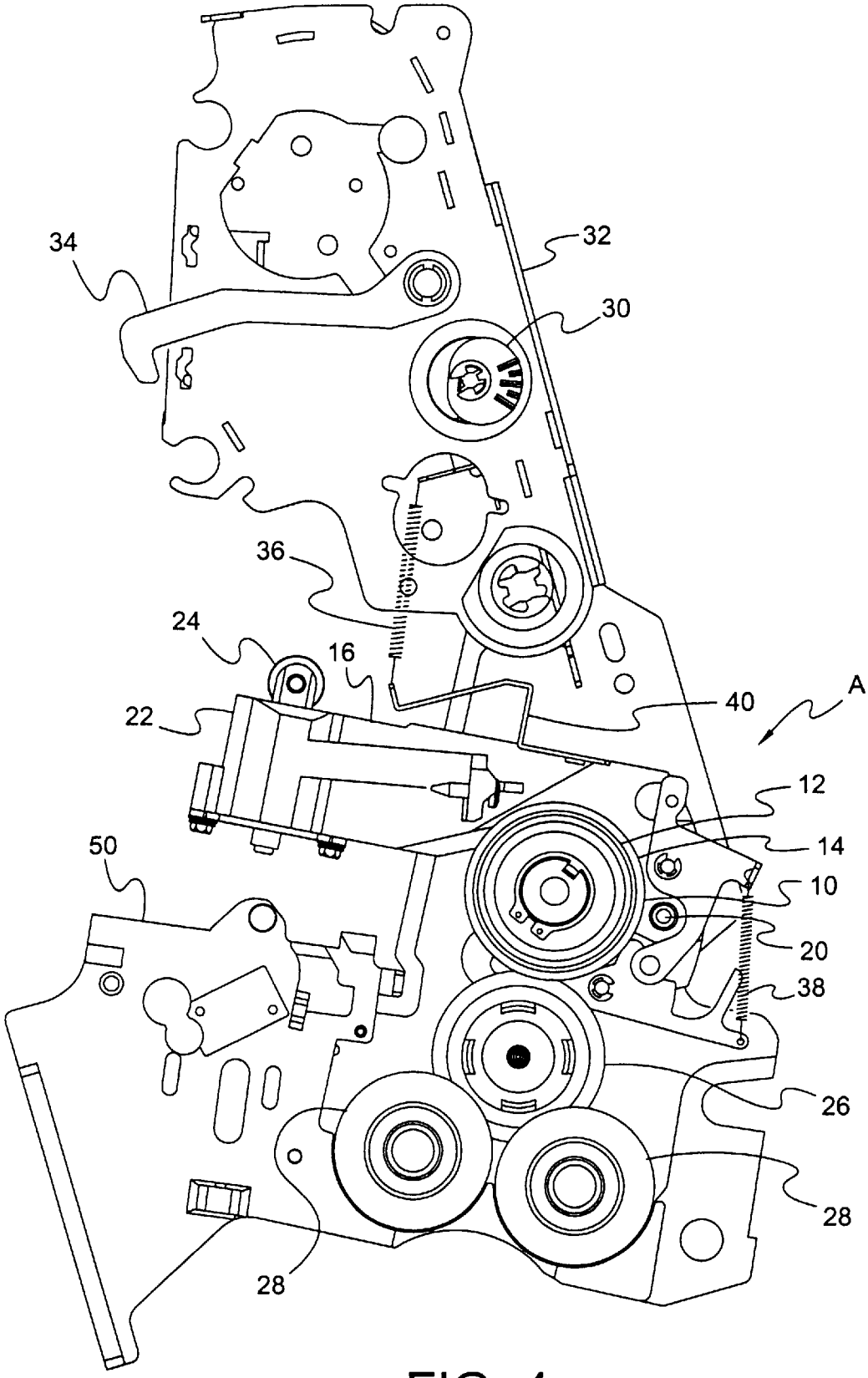
FIG. 4 is schematic diagram of a load arm in position in edgagenient with a pressure roller with a cooler section of a fuser unit section open.

In FIG. 4, a load arm 16 is shown in position in a lower portion 50 of fuser section A. As shown, a cooler section 32 is opened. Cooler section 32 includes a cam 30, which as indicated previously rotates during copying operations, when cooler section 32 is closed to produce the desired pressure on load arm 16. As shown in FIG. 4, a fuser roller 26 is positioned for engagement with pressure roller 10 with fuser roller 26 being contacted by heater rollers 28. A latch 34 is shown in cooler section 32 to maintain cooler section 32 in closed engagement when it is closed. A spring 36 is shown in position to bias cooler section 32 toward a closed position.

Similarly a spring 38 is shown connected to bias load arm 16 toward an open position when cooler section 32 is open.

In FIG. 4 a cross-arm 40 is also shown. While only one load arm 16 is shown in FIG. 4, cross-arm 40 connects a pair of load arms 16 so that they are connected in spatial relationship to each other.

As indicated previously, many components of a copier/duplicator machine are shown in certain of the Figures, including FIG. 4 with only a portion of these components being referred to a necessary to describe the present invention.

Figure 5:
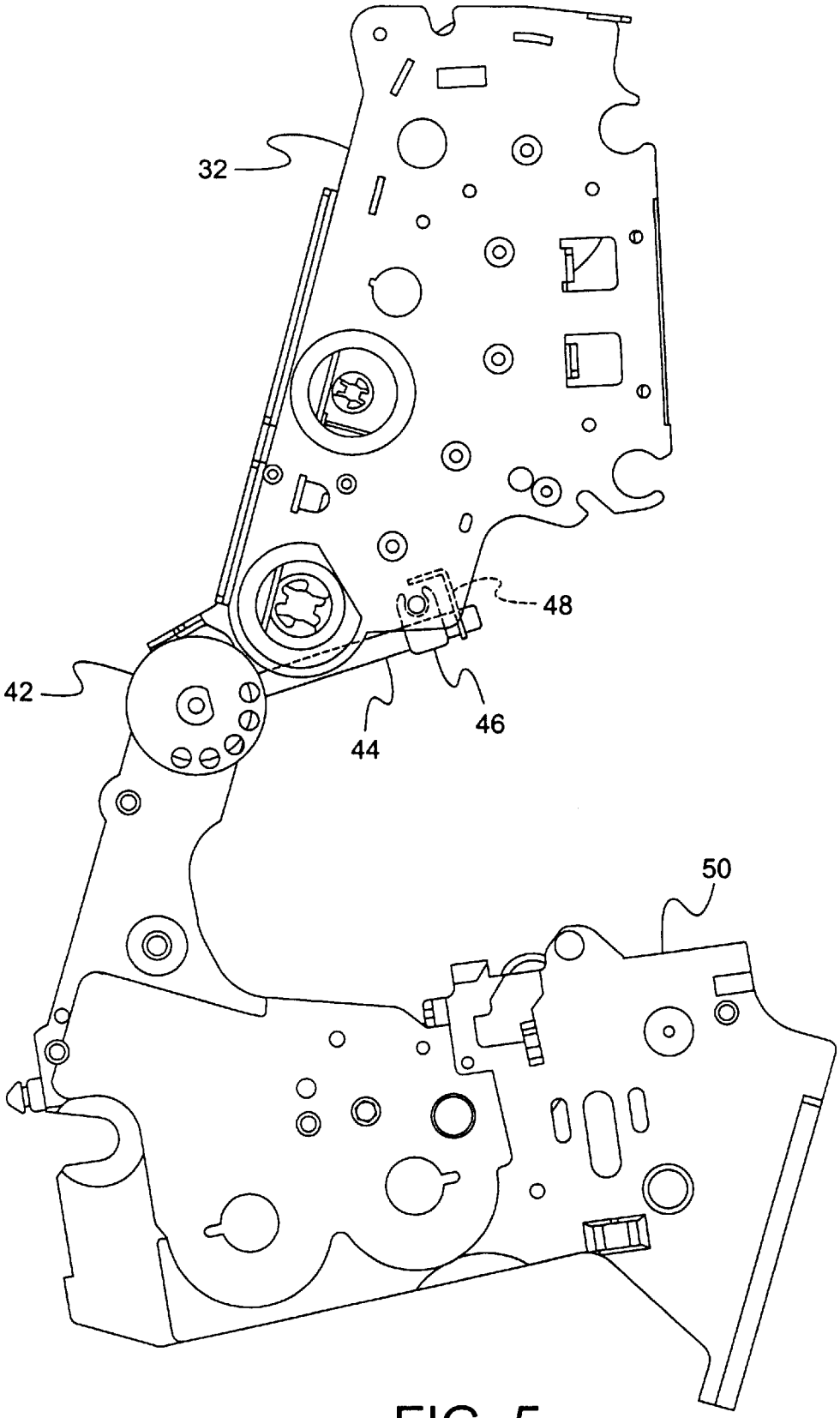
FIG. 5 is a cross-section of a fuser unit section with a cooler section open; and, FIG. 6 is a schematic diagram of the inside surface of the cooler section in an open position.

In FIG. 5, a rod 44 and a stop 46 with a bracket 48 connected to a side casting 42 are shown for limiting the extent to which cooler section 32 can be opened relative to lower portion 50 of the fuser section. According to the present invention, this bracket is removed and cooler section 32 becomes free to rotate by more than 70 degrees preferably from about 75 to about 90 degrees and optionally up to 180 degrees if spring 36 (shown in FIG. 4) and bracket 48 are disconnected. This permits the opening of the cooler section to a greater extent than previously possible and permits better access to the pressure roller receptacle in lower portion 50 of the fuser section.

Figure 6:
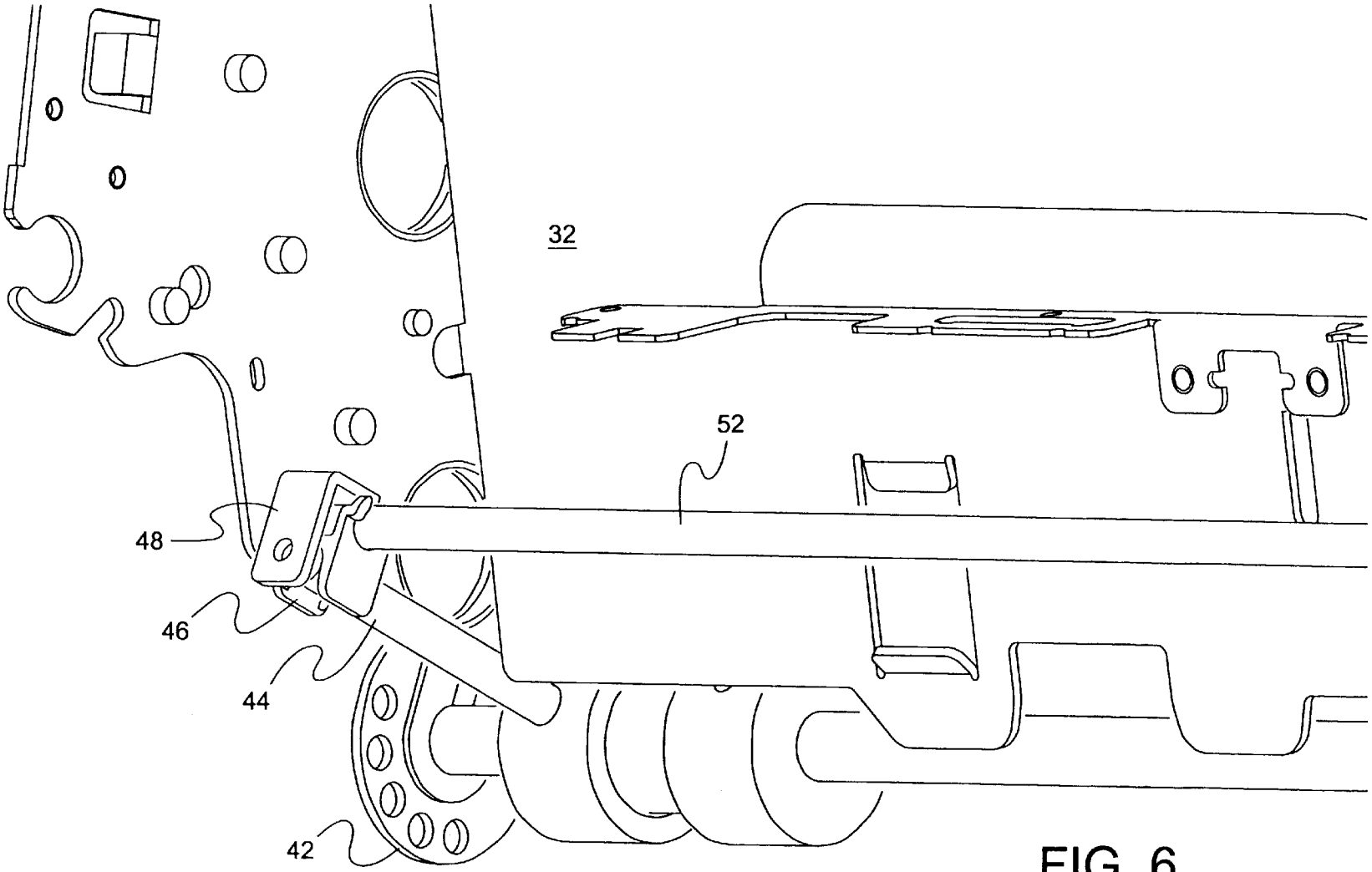

FIG. 6 is a view of the inner surface of cooler section 32 and includes a further showing of rod 44, stop 46 and bracket 48. As shown, stop 46 is slidable along rod 44 to support a cooler section load shaft 52, which limits the upward mobility of cooler section 32 when it is opened.

Cooler section 32 as known to those skilled in the art is frequently opened to clear paper jams and includes facilities for use in cooling the finished paper copies, for recycling paper copies when two-sided copies are to be produced and the like.

As described above, load arms 16 are positioned in proper alignment with the bearing surfaces on pressure roller 10 by the use of the locator plates of the present invention. With the locator plates in position, the lift arms cannot be improperly positioned over the bearing surfaces on pressure roller 10, therefore, the cooler section 32 cannot be closed with the load arms in improper alignment with pressure roller 10. This is a significant improvement in that it prevents the closing of cooler section 32 unless the load arms are properly aligned. This results in a requirement that the load arms be properly aligned before the machine can be closed and operation attempted with resulting damage to the machine. Further the releasing of cooler section 32 as discussed or as required with different configurations of copier/duplicator machines permits greater access to the pressure roller receptacle in the fuser section and permits more reliable installation.

Having thus described the present invention by reference to its preferred embodiments, it is pointed out that the embodiments described are illustrative rather than limiting in nature and that many variations and modifications are possible within the scope of the present invention.

What is claimed is:

1. A copier/duplicator machine having a pressure roller system including two load arms for engagement with two pressure roller bearings on each end of a pressure roller wherein the load arms include locator plates positioned on their outsides and extending beyond an engagement surface on each load arm and toward and past pressure roller bearing engagement surfaces on the pressure roller bearings to restrict the positioning of the load arm engagement surfaces so that the load arms can be installed only in proper engagement with the pressure roller bearings on the ends of the pressure roller.

2. The machine of claim 1 wherein the pressure roller bearings are ball bearings.

3. The machine of claim 1 wherein the load arms are moveable into engagement with the pressure roller bearings by closing a cooler section of the machine into engagement with a lower portion of a fuser unit of the machine.

4. The machine of claim 3 wherein the cooler section is openable by rotary movement relative to the lower portion of the fuser unit to more than 70 degrees relative to the top of the lower portion of the fuser unit.

5. A load arm system for a copier/duplicator machine for applying pressure to a pressure roller having pressure roller bearings positioned on its ends, the pressure roller bearings having pressure roller bearing engagement surfaces, the system comprising:

a) two load arms each having a first and a second end and being retained in a fixed spatial relationship to each other, each having a load arm engagement surface configured for engagement with one of the pressure roller bearing engagement surfaces at their first ends, and rotatably connected at their first ends to the machine for rotation of the load arm engagement surfaces into engagement with the pressure roller bearing engagement surfaces;

b) a pressure source in operative contact with the second ends of the load arms and adapted to apply a selected pressure to the pressure roller by applying a selected pressure to the second ends of load arms;

c) a locator plate positioned on the outside of the first ends of the load arms and extending past the load arm engagement surfaces and the pressure roller bearing engagement surfaces so that when the load arms are installed with the locator plates outside the pressure roller bearing engagement surfaces the pressure roller and the load arms are properly positioned.

6. The load arm system of claim 5 wherein the pressure source comprises a chamber containing a spring, the spring being compressible by a contact member in the top of the chamber and positioned to engage and compress the spring when pressure is applied to the contact member to impose the selected pressure on the pressure roller.

7. The load arm system of claim 5 wherein the load arms are connected by a cross bar.

8. A method for installing a pressure roller in a copier/duplicator machine in proper orientation to load arms rotatably connected to the machine, the method comprising:

a) configuring a machine cooler section openable by rotary movement relative to a fuser unit lower section for rotary movement to an open position wherein the cooler section is rotated to an angle greater than 70 degrees relative to the fuser unit lower section thereby providing improved access to the fuser unit lower section for installation of a pressure roller;

b) positioning the pressure roller in a pressure roller receptacle in the fuser unit lower section of the machine;

c) positioning locator plates on the load arms so that the load arms can be moved into engagement with the pressure roller only when the load arms are in proper alignment with pressure roller bearing surfaces; and d) moving the load arms into properly aligned engagement with the pressure roller bearing surfaces.

9. The method of claim 8 wherein the angle is from about 75 to about 90 degrees.

* * * * *